US007275266B1

(12) United States Patent
Grilliot et al.

(10) Patent No.: US 7,275,266 B1
(45) Date of Patent: Oct. 2, 2007

(54) PROTECTIVE GARMENT HAVING REFLECTIVE, FLUORESCENT, OR VISION-ENHANCING STRIP HAVING END SEAM COVERED BY PROTECTIVE STRIP

(75) Inventors: William L. Grilliot, Dayton, OH (US); Mary I. Grilliot, Dayton, OH (US); Patricia K. Waters, Tipp City, OH (US)

(73) Assignee: Morning Pride Manufacturing, L.L.C., Dayton, OH (US)

( * ) Notice: Subject to any disclaimer, the term of this patent is extended or adjusted under 35 U.S.C. 154(b) by 40 days.

(21) Appl. No.: 11/390,839

(22) Filed: Mar. 28, 2006

(51) Int. Cl.
*A41D 13/00* (2006.01)

(52) U.S. Cl. ..... 2/81

(58) Field of Classification Search ..... 2/81, 2/243.1, 244, 93, 94, 102, 108, 69, 79, 227, 2/456; 112/418
See application file for complete search history.

(56) References Cited

U.S. PATENT DOCUMENTS 2,353,984 A * 7/1944 Barone ..... 112/414
3,563,198 A * 2/1971 Johnston ..... 112/402
5,054,125 A * 10/1991 Snedeker ..... 2/81
5,884,332 A * 3/1999 Snedeker ..... 2/97
6,701,532 B1 * 3/2004 Glassberg et al. ..... 2/170
6,807,684 B2 10/2004 Lewis
7,117,545 B2 * 10/2006 Hannon et al. ..... 2/275

* cited by examiner

*Primary Examiner*—Tejash Patel
(74) *Attorney, Agent, or Firm*—Wood, Phillips, Katz, Clark & Mortimer

(57) ABSTRACT

In a protective garment comprising an outer shell, wherein a reflective, fluorescent, or vision-enhancing strip is sewn to the outer shell on a generally tubular portion of the protective garment so that one end of the reflective, fluorescent, or vision-enhancing strip overlaps and is sewn to an opposite end of the reflective, fluorescent, or vision-enhancing strip, a protective strip, which covers the seam of the reflective, fluorescent, or vision-enhancing strip and which covers the end that overlaps and is sewn to the opposite end of the reflective, fluorescent, or vision-enhancing strip, is sewn to the outer shell and to the reflective, fluorescent, or vision-enhancing strip. The protective strip-is-made from a wear-resistant fabric.

3 Claims, 1 Drawing Sheet

PROTECTIVE GARMENT HAVING REFLECTIVE, FLUORESCENT, OR VISION-ENHANCING STRIP HAVING END SEAM COVERED BY PROTECTIVE STRIP

TECHNICAL FIELD OF THE INVENTION

This invention pertains to a protective garment, such as a firefighter's garment, of a type comprising an outer shell and a reflective, fluorescent, or vision-enhancing strip, which is sewn to the outer shell, substantially or completely around a generally tubular portion of the protective garment. This invention provides the protective garment with a protective strip, which covers one end of the reflective strip, were the covered end meets, is near, or overlaps the opposite end of the reflective strip.

BACKGROUND OF THE INVENTION

Protective garments of the type noted above are available commercially from Morning Pride Manufacturing, L.L.C. of Dayton, Ohio, under its MORNING PRIDE trademark, and from other sources. Reflective or fluorescent strips for such garments are available commercially from Minnesota Mining and Manufacturing Company of Saint Paul, Minn., under its SCOTCHLITE trademark, from Reflexite Corporation of Avon, Conn., under its REFLEXITE trademark, and from other sources. Typically, a protective garment of the type noted above has multiple reflective, fluorescent, or vision-enhancing strips of other types, such as strips having a color contrasting with the color of the protective garment, on arm portions, on leg portions, and elsewhere.

Typically, on an arm portion or on a leg portion, the reflective, fluorescent, or vision-enhancing strip has a seam where one end of the reflective strip meets, is near, or overlaps to the opposite end of the reflective strip. If one end overlaps the opposite end, the overlapping end may be also sewn to the overlapped end. Heretofore, when a protective garment of the type noted above was worn under adverse conditions, such a seam and threads used at such a seam were prominent so as to be particularly susceptible to possible abrasion, particularly if a wearer of the protective garment, such as a firefighter, crawled on or brushed against an abrasive object.

Further background of related interest is provided by U.S. Pat. No. 6,807,684 B2, which is assigned to Morning Pride Manufacturing, L.L.C. of Dayton, Ohio.

SUMMARY OF THE INVENTION

This invention provides a protective garment comprising an outer shell and a reflective, fluorescent, or vision-enhancing strip, which is sewn to the outer shell on a generally tubular portion of the protective garment so that a given end of the reflective, fluorescent, or vision-enhancing strip meets, is near, or overlaps an opposite end of the reflective, fluorescent, or vision-enhancing strip, wherein the protective garment comprises a protective strip, which covers the given end of the reflective, fluorescent, or vision-enhancing strip.

Preferably, the protective strip is made from a wear-resistant fabric, such as a p-aramid or an m-aramid. Preferably, the protective strip covers the end that meets, is near, or overlaps the opposite end. Preferably, the protective strip is sewn to the outer shell.

DETAILED DESCRIPTION OF THE ILLUSTRATED EMBODIMENT

Figure 1:
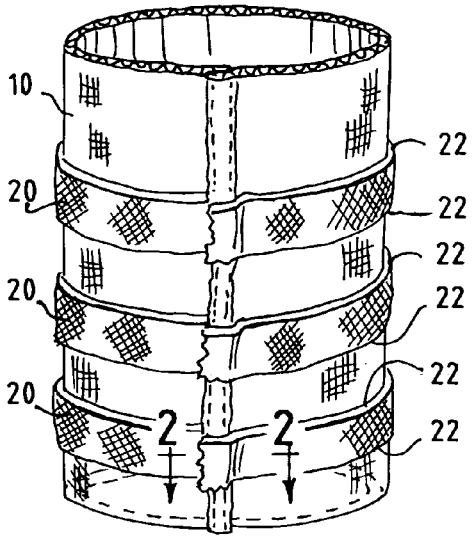
FIG. 1 PRIOR ART
FIG. 1, which exemplifies prior art, is a fragmentary, perspective view illustrating a generally tubular portion of a protective garment, such as an arm portion of a protective coat or a leg portion of a pair of protective pants, and illustrating three reflective strips, each of which is sewn to the arm portion and each of which has a seam where one end of the reflective strip overlaps and is sewn to the opposite end of the reflective strip.
Figure 2:
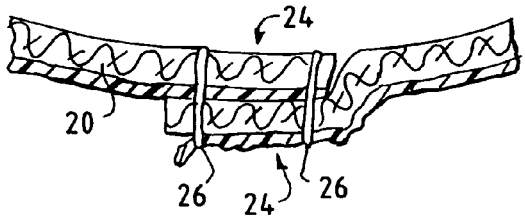
FIG. 2 PRIOR ART
FIG. 2, on an enlarged scale, is a sectional view taken along line 2-2 in FIG. 1, in a direction indicated by arrows.

As illustrated in FIGS. 1 and 2, which exemplify prior art, it is conventional for a generally tubular portion 10 of a protective garment, such as an arm portion of a protective coat or a leg portion of a pair of protective pants, to have plural reflective strips 20, which are sewn to the generally tubular portion 10, along the opposite margins 22 of each reflective strip 20. If the protective garment has an outer shell and a lining system (not illustrated) which comprises a liner or liners within the outer shell, each reflective strip 20 is sewn to the outer shell, at the generally tubular portion 10.

Moreover, it is conventional for each reflective strip 20 to have a seam 24, where one end of said reflective strip 20 overlies and is sewn to the other end of said reflective strip 20 and to the generally tubular portion 10. Thus, the seam 24 and the threads 26 used to sew the overlying end of said reflective strip 20 to the other end of said reflective strip 20 and to the generally tubular portion 10 are prominent, so as to be particularly susceptible to abrasion, as discussed above. Alternatively, if one end does not overlap the other end, each reflective strip 20 has a seam where the respective ends of said reflective strip meet or, at each end, has a seam where the respective seams are near each other.

Figure 4:
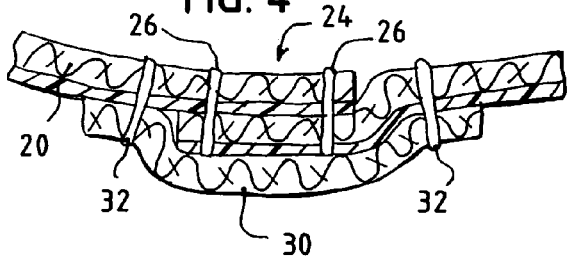
FIG. 4, on a scale similar to the scale of FIG. 2, is a sectional view taken along line 2-2 in FIG. 1, in a direction indicated by arrows.
Figure 3:
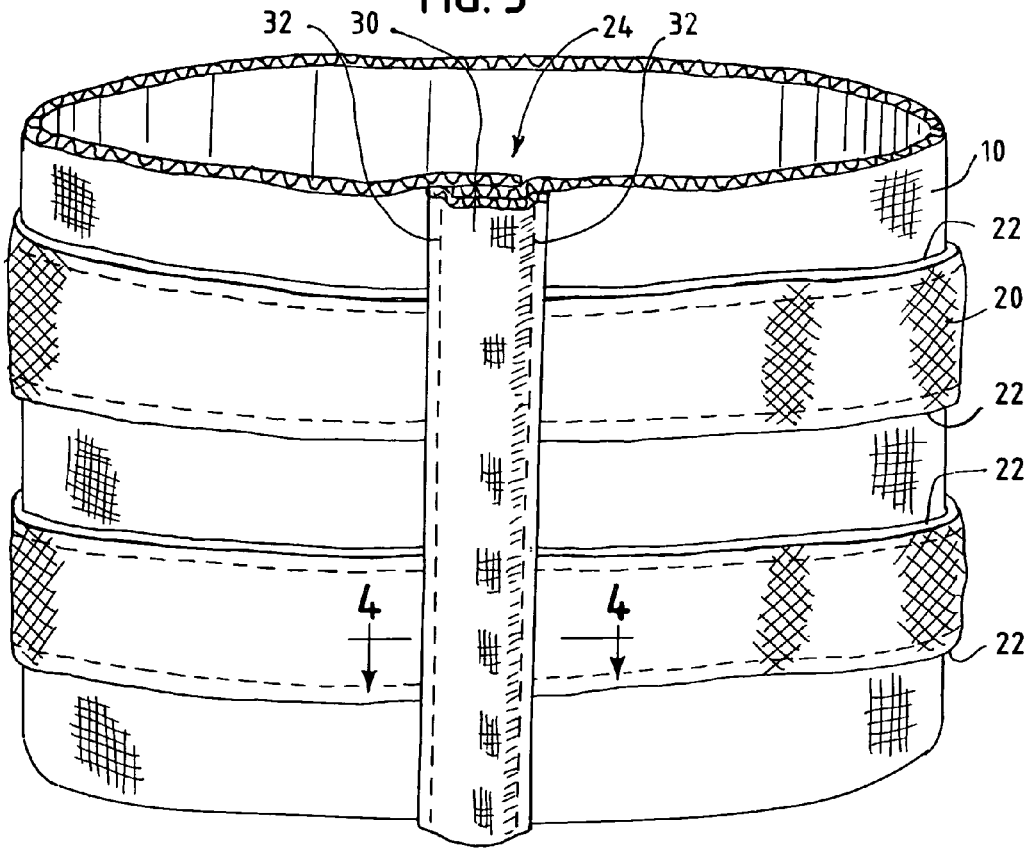
FIG. 3, on a further enlarged scale, is a fragmentary, perspective view illustrating a generally tubular portion of a protective garment, such as an arm portion of a protective coat or a leg portion of a pair of protective pants, illustrating two reflective strips, each of which is sewn to the generally tubular portion and each of which has a seam where one end of the reflective strip overlaps and is sewn to the opposite end of the reflective strip, and illustrating, as contemplated by this invention, a protective strip, which covers the seams of the reflective strips.

As illustrated in FIGS. 3 and 4, it is contemplated by this invention for a protective strip 30 of wear-resistant fabric, such as a p-aramid fabric or an m-aramid fabric, to cover the seams 24 and the threads 26 of each reflective strip 20. The protective strip 30 is sewn, via threads 32, to each reflective strip 20 and to the generally tubular portion 10.

The protective strip 30 is sacrificial, in a sense that the protective strip 30 can be abraded while protecting the seams 24 and the threads 26 against being abraded. Eventually, when the protective garment is being rehabilitated for reuse, it is expected to be far less expensive to replace the protective strip 30, than to replace any of the reflective strips 20.

Rather than one protective strip 30 being used with plural reflective strips 20, separate protective strips may be alternatively used, one for each reflective strip 20. Rather than reflective strips, fluorescent strips or vision-enhancing strips of other types, such as strips having a color contrasting with the color of the generally tubular portion 10 of the protective garment, may be alternatively provided.

The invention claimed is:

1. A protective coat or pant comprising an outer shell and a reflective or flourescent strip, which is sewn to the outer shell on a generally tubular portion of the protective coat or pant so that a given end of the reflective or flourescent strip meets, is near, or overlaps an opposite end of the reflective or flourescent strip, wherein the protective coat or pant comprises a protective strip, which covers the given end that meets, is near, or overlaps the opposite end, wherein the protective strip is sewn to the outer shell and to the reflective or flourescent strip.

2. The protective coat or pant of claim 1, wherein the given end overlaps and is sewn to the opposite end of the reflective or flourescent strip at a seam, which is covered by the protective strip.

3. The protective strip of any preceding claim, wherein the protective strip is made from a wear-resistant fabric.

* * * * *